US006264151B1

(12) United States Patent
Schiller

(10) Patent No.: US 6,264,151 B1
(45) Date of Patent: Jul. 24, 2001

(54) WORK STATION INCORPORATING LADDER ATTACHMENTS

(76) Inventor: Charles V. Schiller, 25 W, 231 Salem, Naperville, IL (US) 60540

( * ) Notice: Subject to any disclaimer, the term of this patent is extended or adjusted under 35 U.S.C. 154(b) by 0 days.

(21) Appl. No.: 09/061,576

(22) Filed: Apr. 16, 1998

(51) Int. Cl.[7] ..... E06C 7/00

(52) U.S. Cl. ..... 248/238; 248/210; 182/129

(58) Field of Search ..... 248/210, 201, 248/235, 238, 231.9, 211; 182/122, 129

(56) References Cited

U.S. PATENT DOCUMENTS 3,985,203 * 10/1976 Erlenbach ..... 248/210
4,222,541 * 9/1980 Cillis ..... 248/210
4,318,454 * 3/1982 Johnson ..... 248/210
4,424,949 * 1/1984 Kimmett et al. ..... 248/238
4,445,659 * 5/1984 LaChance ..... 248/210
4,660,794 * 4/1987 Given ..... 182/129
4,995,578 * 2/1991 Monheim ..... 248/210
5,259,525 * 11/1993 Wion ..... 248/210
5,526,897 6/1996 Schiller .
5,865,409 * 2/1999 Nimer ..... 248/210

* cited by examiner

*Primary Examiner*—Ramon O Ramirez
*Assistant Examiner*—Jon Szumny
(74) *Attorney, Agent, or Firm*—Wallenstein & Wagner, Ltd

(57) ABSTRACT

A work station (1) is formed by connecting two bracket members (10) to legs (4) of a ladder (2). Each bracket (10) includes jaws (12) for holding objects parallel to the ground and a mechanism (21,60,23,24,25,26) for rotatable connecting the bracket to the leg, (4).

41 Claims, 3 Drawing Sheets

WORK STATION INCORPORATING LADDER ATTACHMENTS

DESCRIPTION

1. Technical Field

The present invention relates to work stations and more particularly a pair of bracket support members attachable to a ladder for supporting a work surface, platform or equipment.

2. Background to the Invention

Today, an individual working with tools and equipment is often faced with a problem of quantity. Specifically, one at a construction site or fixing something around the house will oftentimes need tools, such as screwdrivers and hammers, and equipment, such as power drills or saws. Unfortunately, depending both on the task at hand and the individual, there are frequently the issues of limited personnel to carry and move such materials and limited space to work. For example, if a table or platform is needed at the site, one may need to bring an actual table or platform to the site, or erect/make one, such as with a couple of sawhorses and board.

Many, if not most, workers setting out to the above activities have a ladder. This ladder, while oftentimes six feet or greater, serves one purpose, to permit one to climb it to reach a higher elevation. Sometimes, one may rig a ladder for other purposes, e.g., nailing items to the side thereof, supporting a can of paint. This can, at times, be dangerous. It is, nevertheless, an inconvenience.

Accordingly, there is a need for safe multi-task use of a ladder to alleviate some of the above noted issues and problems.

SUMMARY OF THE INVENTION

The present invention is a device that can be easily attached, permanently or temporarily, to a ladder for converting the ladder into a multi-task piece of equipment. A bracket support member is attached to each of the two legs of the ladder. The bracket support members can be "folded" for storage and during transportation of the ladder. Or, the brackets can be pivoted into position for use. When in a use position, the brackets can safely and securely support numerous items, such as a table top or plank, on either side of the ladder. This table top or plank can also be used as a shelf to support items, such as paint, tools, equipment (e.g., table saw or miter saw), clamps, a vice, etc., or the plank/table top can be used to hang items from, such as a tool belt, plumb bob, etc. The brackets can be further used as an easel to support items standing up thereon and leaning against the ladder. Or, the brackets can be used on stud walls. Further, the item supported (e.g., table top) can be configured (i.e, with an opening, switch, rail, etc ) to work in conjunction with bench top power tools, such as a power miter box, grinder, router, etc. One can also use the brackets to form a lay-out table, to cut pipe, or as a saw horse. Additional brackets located at different heights can be used as shelving at a job site for multiple or multi-tool tasks. In some situations, the bracketed plank/table top can support an individual, thus converting the single ladder to a platform, a scaffold or even a seat.

Each bracket permits attachment at different levels of the ladder, permitting selective heights for supporting the plank/table top. The brackets are also constructed to support planks or table tops of different thicknesses. The brackets can be used at either side of the ladder, the stepping side or supporting side. And, the brackets of the present invention can be used for regular ladders and extension ladders.

Turning to the specifics of the workstation, according to a first aspect of the present invention, a work station is provided for use in combination with a ladder having at least two legs. The work station includes a pair of support members, with each support member being rotatably connected at a fixed height to a leg of the ladder. Each of these support members has an opening at the distal end thereof for holding an object disposed within the opening and means within the member for supporting an object parallel to the ground. In particular, the opening is formed of at least two contiguous slots juxtaposed adjacent one another. Both slots share a lower wall; each slot has an upper wall parallel the common lower wall; and, the distance between the upper wall of the first slot and the lower wall is less than the distance between the upper wall of the second slot and the lower wall. An object, such as a table top, plank, saw table, router table, drill press, etc. is thus held and disposed between the lower wall and the upper wall of either the first slot or the second slot.

According to another aspect of the present invention, each slot has a stop formed by a back wall of that slot for preventing the object disposed within the opening from contacting the leg of the ladder. And, a first support ledge projects outwardly adjacent and along the lower wall of the contiguous slots, a second support ledge projects outwardly adjacent and along the upper wall of the first slot, and a third support ledge projects outwardly adjacent and along the upper wall of the second slot. Each of the first support ledge, second support ledge and third support ledge can be a separate outwardly projecting flanges lending structure support to the slot walls.

According to still another aspect of the invention, an inwardly projecting first bumper is configured so as to abut the leading edge of the leg of the ladder and to position the support member against the outer surface of the leg of the ladder and totally within the imaginary planes formed by extending the leading and rear edges of the leg of the ladder. There is also an inwardly projecting second bumper positioned so as to contact the leading edge of the leg of the ladder when the object being supported is substantially parallel to the ground. The first bumper is an inwardly projecting flange and the second bumper is a rear edge of the inwardly projecting flange forming the first bumper.

In practice, the distance between the lower wall and the upper wall of the first slot is generally 13/16 inches and the distance between the lower wall and the upper wall of the second slot is generally 1 9/16 inches. Moreover, the lower wall is approximately 2½ inches. Thus, the object being held within the opening, having a substantially flat surface, can have a nominal or stock thickness of approximately either 1½ inches or ¾ inches and a width at least the distance between the outer edges of the two legs of the ladder supporting the support members.

The bracket can be made of several materials, such as plastic or metal.

Other advantages and aspects of the present invention will become apparent upon reading the following description of the drawings and detailed description of the invention.

BRIEF DESCRIPTION OF THE DRAWINGS

In order that the present invention may be more fully understood, it will now be described by way of example, with reference to the accompanying drawings in which.

DETAILED DESCRIPTION OF THE INVENTION

Figure 1:
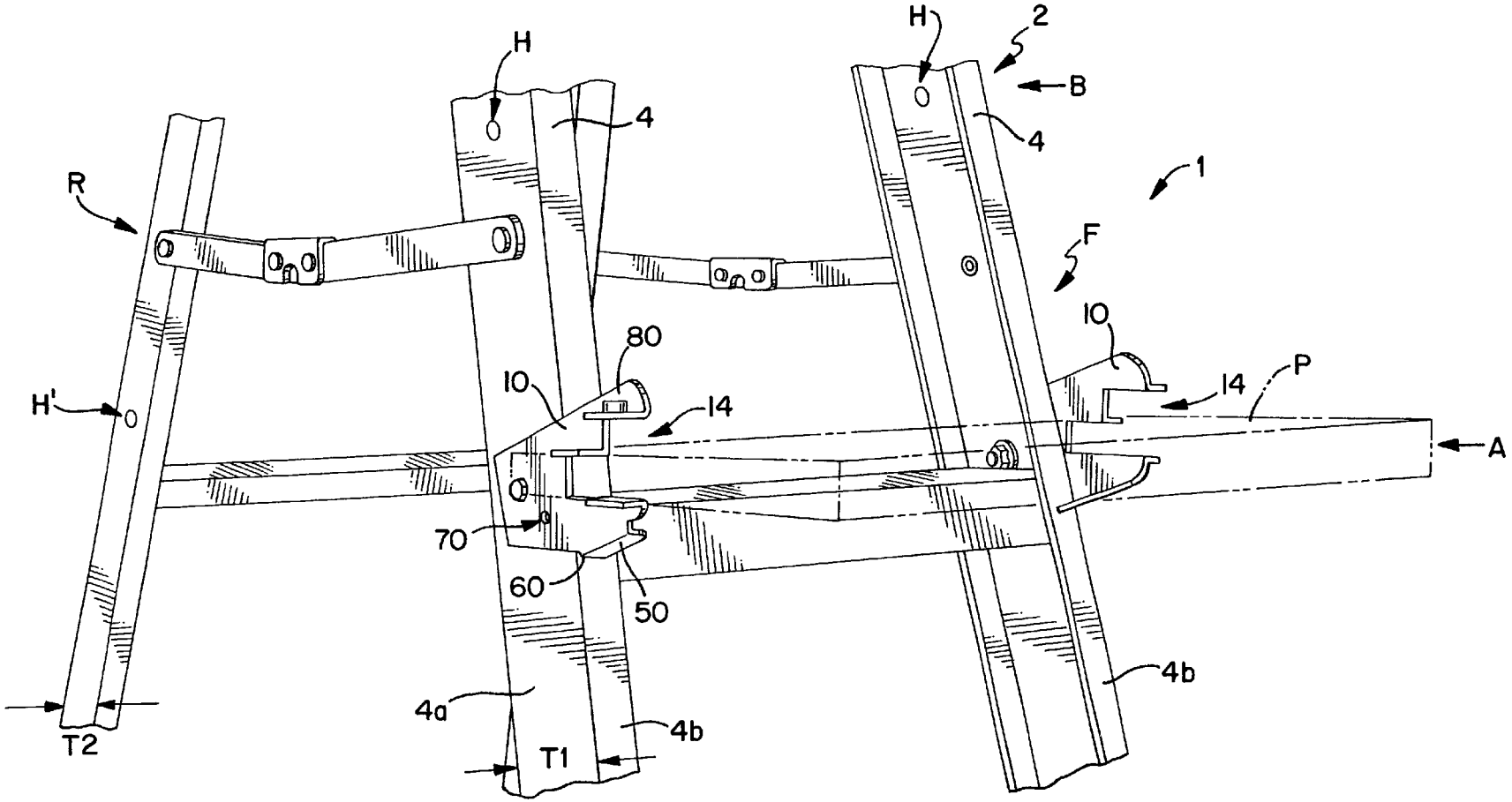
FIG. 1 is a perspective view of the work station of the present invention.

The work station of the present invention, generally designated by reference number 1, is formed by attaching two support members 10 to a ladder 2. Specifically, each support member 10, or bracket, attaches to the exterior of a leg 4 of the ladder 2 at different levels (e.g., height A or height B). More particularly, the brackets 10 are rotatably connected at a fixed height (e.g., height A or height B) to the ladder legs, namely the front, stepping portion of the ladder (generally designated F), or rear, supporting section of the ladder (generally designated R).

The specifics of the support members of one embodiment are shown in FIGS. 1 through 5. For clarity, only one bracket will be discussed; however, it should be noted the brackets are mirror images of one another. The bracket 10 has a main body 11 with two ends, namely a front end or distal end 12 and a rear end 13. An opening, generally designated 14, is formed into the distal end 12. This distal end 12 in combination with the opening 14 holds items P (shown in phantom) of various sizes.

The bracket 10 is attached to the leg 4 by means of an aperture 21 disposed within the body 11 of the bracket and a fastener passing through the aperture 21 and a hole (not shown at height A, but shown at height B by the reference letter H) provided in the leg 4. The fastener shown employs a bolt 23, having a bolt head 24, attached nut 25 and washer 26 combination for this pivoting connection. As noted in the figures, attachment is to the outer side 4*a* of the leg 4. This arrangement permits the bracket 10 to rotate relative to the leg between an "in-use" position (FIGS. 1 and 2) wherein the object P being held by the bracket is held parallel to the ground and a "non-use" position (FIG. 3) wherein the bracket is stowed away or conveniently stored in an upright position.

Turning to the front or distal end 12 of the bracket 10, or the "jaw" section, there is an opening 14 having a specific configuration. This configuration is designed to hold objects, such as planks P, having a nominal, carpenter or stock thickness of ¾ inches and/or 1½ inches. A first slot 30 is provided having an upper wall 31 and a parallel lower wall 32. In the down or "in-use" position, these upper and lower walls 31,32, and hence the slot 30, are oriented parallel to the ground with any object P being held within the slot 30 and between the walls 31,32 also being parallel the ground. The slot 30 further has a back wall or stop 33 for preventing the object disposed within the opening 14 and slot 30 from contacting the leg 4 of the ladder 2.

A first support ledge 34 projects outwardly adjacent and along the lower wall 32 of the slot 30 for adding structural support to the bracket 10 and slot 30 and to ensure proper positioning of the item being held. This first support flange 34 is an outwardly projecting flange. Similarly, for structural support and position within the slot, a second support ledge 35 projects outwardly adjacent and along the upper wall 31 of the slot 30. This second support ledge 35 is also an outwardly projecting flange.

The front or distal end 12 of the bracket 10 also employs a second slot 40 having an upper wall 41 and a parallel lower wall 42. In the down or "in-use" position, these upper and lower walls 41,42 and the slot 40, are oriented parallel to the ground with any object P being held within the slot 40 and between the walls 41,42 similarly parallel the ground. The slot 40 further has a back wall or stop 43 for preventing the object disposed within the opening 14 and slot 40 from contacting the leg 4 of the ladder 2. A first support ledge 44 projects outwardly adjacent and along the lower wall 42 of the slot 40 for adding structural support to the bracket 10 and slot 40 and to ensure proper positioning of the item P being held. This first support flange 44 is an outwardly projecting flange. Similarly, for structural support and position within the slot, a second support ledge 45 projects outwardly adjacent and along the upper wall 41 of the slot 40. This second support ledge 45 is also an outwardly projecting flange.

In the embodiment illustrated, the two slots 30,40 forming the opening 14 are collinear. Specifically, they are formed together and adjacent one another. Accordingly, both 30,40 actually form a single opening 14. Thus, the lower walls 32,42 of both slots 30,40 form one continuous long wall extending the entire length of the opening 14. Moreover, the first support ledge 32,42 for each slot 30,40 is a single, continuous and extending ledge, as opposed to multiple, separate ledges.

In practice, the distance X between the lower wall 32 and the upper wall 31 of the first slot 30 is 13/16 inches and the distance Y between lower wall 42 and the upper wall 41 of the second slot 40 is 1 9/16 inches. The length Z of lower wall 32,42 is approximately 2½ inches. And, the length W1 of the upper wall 31 of the first slot 30 is 1¼ inches with the length W2 of the upper wall of the second slot 40 being 1¼ inches. With this configuration and dimensions, the object P being held within the opening, e.g., a substantially flat surface, can have a thickness of approximately either ¾ inches or 1½ inches and a width at least the distance between the outer edges (side surfaces 4*a*) of the two legs 4 of the ladder 2 supporting the support members 10.

Figure 2:
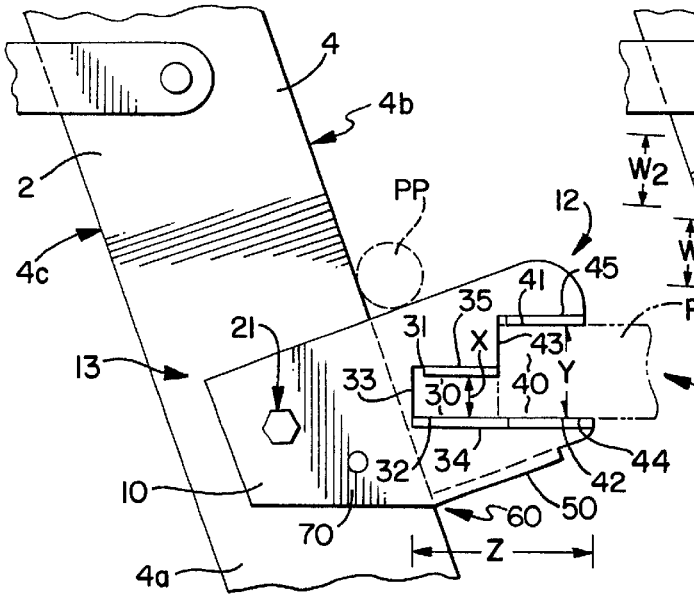
FIG. 2 is a side elevation view of a support member or bracket in the "in-use" position and a part of the leg of the ladder.
Figure 3:
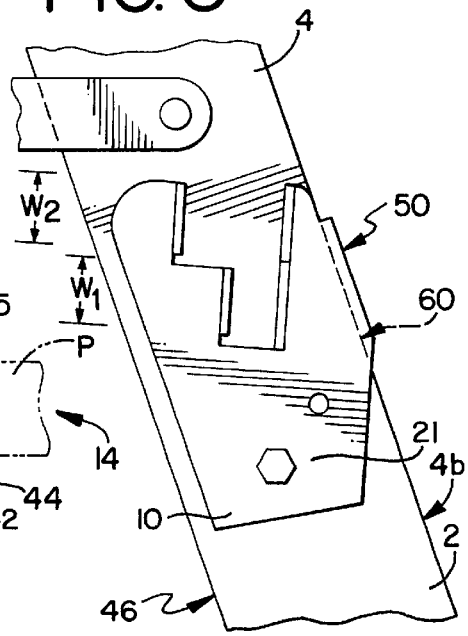
FIG. 3 is a side elevation view of a support member or bracket in the "non-use" position and part of the leg of the ladder.

The bracket 10 further includes two bumpers 50,60. Starting with the second bumper 60, it stops the bracket's downward moving during rotation from the non-use position to the in-use position and orients the bracket so the slots 30,40 are horizontal to the ground. This second bumper can be an inwardly projecting knob that contacts the outer, leading edge 4*b* of the leg 4 of the ladder 2. In addition, as shown in FIGS. 2 and 3, this second bumper 60 can be the rear end/edge of the first bumper 50. Here, the first bumper 50 is an inwardly projecting flange configured so as to abut the leading edge 4*b* of the leg 4 of the ladder 2 and to position the support member 10 against the outer surface of the leg 4 of the ladder 2 and totally within the imaginary planes formed by extending the leading and rear edges 4*b*,4*c* (coming out of the page) of the leg 4 of the ladder 2 (See FIG. 3).

By merely providing apertures at different heights of the ladder legs, (e.g., aperture H (FIG. 1)), the user can attach the support(s) 10 to the ladder 2 at different heights. For multiple shelves, more than two brackets can be employed. For example, if four brackets are employed, with each pair being at similar heights, two shelves can be formed. This can be of great assistance in multi-task, multi-tool jobs.

The bracket is provided with an additional aperture 70 to connect the bracket to the rear R, support leg of the ladder. In particular, the front side or step leg F of the ladder has a side width (T1 in FIG. 1) of approximately 2½ inches to 3½ inches. However, the rear side or leg R has a side width (T2 in FIG. 1) of approximately 1¼ inches to 2 inches. Consequently, on the front leg F of the ladder, one uses the first aperture 21; on the rear leg R of the ladder, one uses another aperture H'. At a second height, one employs a further aperture(s) H (FIG. 1). As with the front side or legs, multiple apertures (H') can be formed in each leg, front or rear, of the ladder for positioning the brackets at different heights (e.g., height A and height B). As a result, in the embodiment illustrated, a bolt 23, having a bolt head 24, and attached nut 25 and washer 26 combination for a pivoting connection are passed through the second aperture 70 and support the bracket 10. This arrangement again permits the bracket 10 to rotate relative to the leg between an "in-use" position (FIG. 2) wherein the object being held by the bracket is held parallel to the ground and a "non-use" position (FIG. 3) wherein the bracket is stowed away or conveniently stored in an upright position. It is, of course, understood that additional, parallel holes need to be made and provided in the legs 4 of the ladder 2. Thus, one can selectively and rotatably connect each support member to the leg of the ladder at fixed, different heights.

For added stability in holding the objects, a clamp, comprised of a set screw 80, may be employed. While not shown in complete detail, such a conventional set screw 80, having a head for grasping and a stud portion passes through an internally threaded channel 78 within the bracket 10 to permit the tip of the set screw to contact and hold any object within the jaws against the lower wall 32,42. The tip of the set screw can optionally be provided with a ball/bumper, conventional for most clamps, for greater surface for clamping. When using the bracket 10 as an easel, the projecting set screw acts as a bumper or stop for the leaning materials resting against the upper legs of the ladder.

Finally, the bracket 10 is designed to form an upper V-shape seat for resting pipes on the bracket. As shown in FIG. 2, a pipe PP can be seated across the top surfaces of the brackets against the ladder legs. The secured pipe can thus be worked on, such as notched, cut or joined. It should be noted, brackets 10 without an opening can be used to support such a pipe PP on the brackets' upper surfaces above and parallel the ground.

Figure 6:
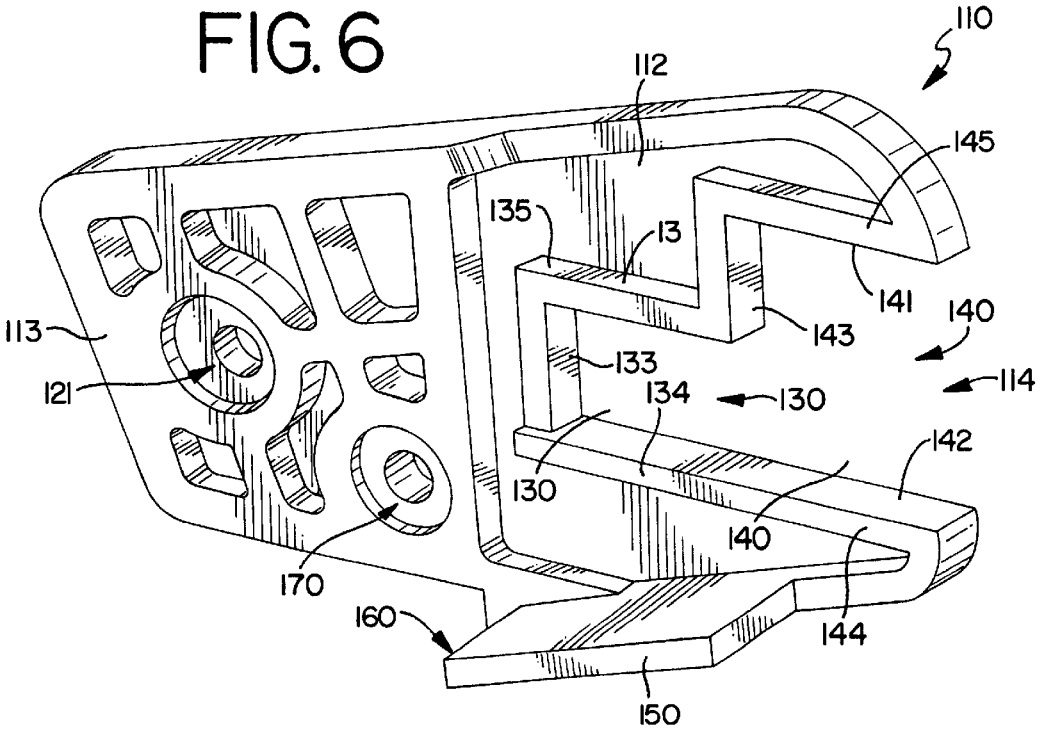
Figure 4:
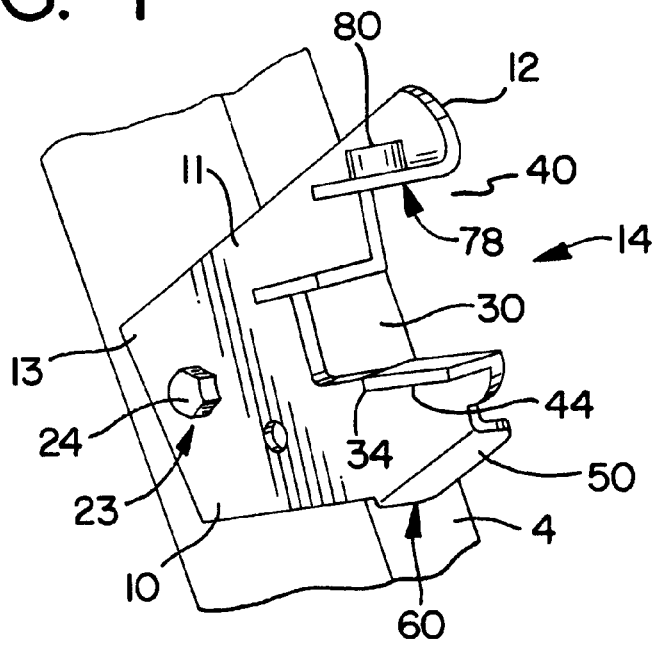
FIG. 4 is an enlarged view of one of the support members shown in FIG. 1.
Figure 5:
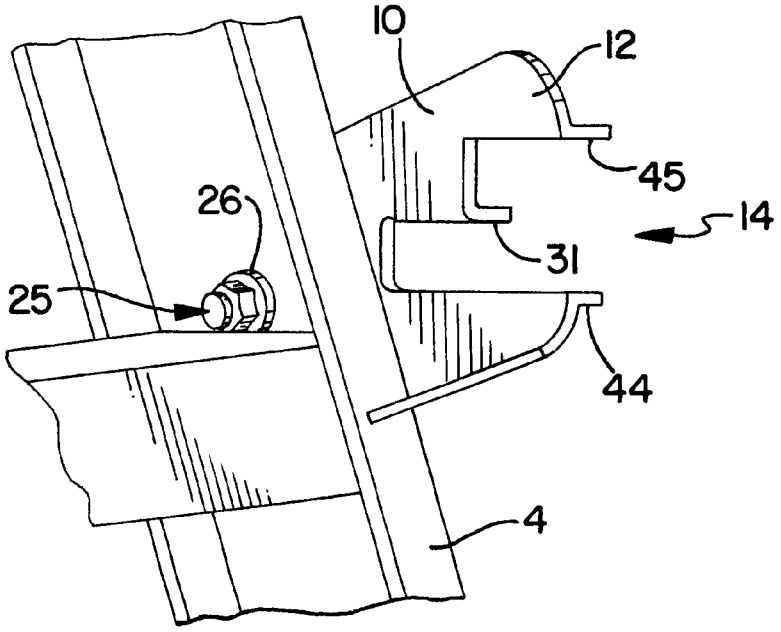
FIG. 5 is an enlarged view of the other of the support members shown in FIG. 1; and, FIG. 6 is a perspective view of one of the support members of a further embodiment.

The embodiments of the bracket 10 discussed are formed of cut or stamped metal with flanges bent therein. This is but one technique to make the product. It can also be made with other materials. For example, FIG. 6 shows a bracket 110 (for clarity, similar components have the same reference numbers, but in the 100 series) formed of molded plastic. In this additional embodiment 110, flanges are replaced with sturdy (and possibly thicker) walls.

While the invention has been described with reference to some preferred embodiments of the invention, it will be understood by those skilled in the art that various modifications may be made and equivalents may be substituted for elements thereof without departing from the broader aspects of the invention. The present examples and embodiments, therefore, are illustrative and should not be limited to such details.

I claim:

1. A work station comprising:

a ladder having at least two legs, each leg having a leading edge, a rear edge and opposed side edges;

a pair of support members with each support member being rotatably connected at a fixed height to a leg of the ladder, each support member having an opening at a distal end thereof for holding an object disposed within the opening; and, a pivoting connection permitting each of the support members to rotate relative to the legs between an in-use position wherein an object disposed within the openings can be held parallel to the ground directly in front of the leading edge of the ladder leg and a non-use, stow-away position, and a stop integral with each support member to contact the ladder and to position each support member within the imaginary planes formed by extending the leading and rear edges of the leg of the ladder.

2. The work station of as defined in claim 1, wherein the pivoting connection includes a pivot pin passing through aligned apertures in the support member and the side of the leg of the ladder.

3. The work station as defined in claim 2, wherein the pivot pin is a bolt having a head at one end and passing through the support member and ladder leg and a washer with a nut attached to an opposed end of the bolt.

4. The work station as defined in claim 3 wherein each support member has more than one aperture therein for attaching the support member to a rear leg of the ladder.

5. The work station as defined in claim 1, wherein the opening in each support member is a slot having an upper wall and a parallel lower wall for holding an object disposed therebetween, and a stop for preventing an object disposed within the opening from contacting the leg of the ladder.

6. The work station as defined in claim 5, wherein the stop is the back wall of the opening.

7. A work station comprising:

a ladder having at least two legs;

a pair of support members with each support member being rotatably connected at a fixed height to a leg of the ladder, each support member having an opening at a distal end thereof for holding an object disposed within the opening, the opening in each support member being a slot having an upper wall and a parallel lower wall for holding an object disposed therebetween with a stop formed by the back wall of the opening for preventing an object disposed within the opening from contacting the leg of the ladder;

a pivoting connection permitting the support member to rotate relative to the leg between an in-use position wherein an object disposed within the opening can be held parallel to the ground and a non-use, stow-away position; and, a first support ledge projecting outwardly adjacent and along the lower wall of the opening.

8. The work station as defined in claim 7, wherein the first support ledge is an outwardly projecting flange.

9. The work station as defined in claim 8, further including a second support ledge projecting outwardly adjacent and along the upper wall of the opening.

10. The work station as defined in claim 9, wherein the second support ledge is an outwardly projecting flange.

11. A work station comprising:

a ladder having at least two legs with each leg of the ladder having an outer surface and a leading edge and a rear edge;

a pair of support members with each support member being rotatably connected at a fixed height to a leg of the ladder, each support member having an opening at a distal end thereof for holding an object disposed within the opening;

a pivoting connection permitting each support member to rotate relative to the connected leg between an in-use position wherein an object disposed within the opening can be held parallel to the ground and a non-use, stow-away position; and, an inwardly projecting first bumper configured so as to abut the leading edge of the leg of the ladder and to position each support member against the outer surface of the connected leg of the ladder and totally within the imaginary planes formed by extending the leading and rear edges of the leg of the ladder.

12. The work station as defined in claim 11, wherein the first bumper is an inwardly projecting flange.

13. The work station as defined in claim 12, further including an inwardly projecting second bumper positioned so as to contact the leading edge of the leg of the ladder when an object being supported is substantially parallel to the ground.

14. The work station as defined in claim 13, wherein the second bumper is a rear edge of the inwardly projecting flange forming the first bumper.

15. The work station as defined in claim 14, wherein the distance between the lower wall and the upper wall of the opening is generally either 1½ nominal inches or ¾ nominal inches.

16. The work station as defined in claim 15, wherein the lower wall is approximately 2½ inches.

17. The work station as defined in claim 1, wherein an object held within the opening is a substantially flat surface has a thickness approximately either ¾ nominal inches or 1½ nominal inches and a width at least the distance between the outer edges of the two legs of the ladder supporting the support members.

18. A work station comprising:

a ladder having at least two legs;

a pair of support members with each support member being rotatably connected at a fixed height to a leg of the ladder, each support member having an opening at the distal end thereof for holding an object disposed within the opening; and, means within the member for supporting an object parallel to the ground, the opening being at least two contiguous slots juxtaposed adjacent one another, both slots sharing a lower wall and each slot having an upper wall parallel the lower wall, the distance between the upper wall of the first slot and the lower wall being less than the distance between the upper wall of the second slot and the lower wall, the object being held within the opening between the lower wall and the upper wall of either the first slot or the second slot.

19. The work station as defined in claim 18, wherein each support member is made of molded plastic.

20. The work station as defined in claim 18, wherein each slot has a stop formed by a back wall of the slot for preventing an object disposed within the opening from contacting the leg of the ladder.

21. The work station as defined in claim 20, further including a first support ledge projecting outwardly adjacent and along the lower wall of the contiguous slots, a second support ledge projecting outwardly adjacent and along the upper wall of the first slot, and a third support ledge projecting outwardly adjacent and along the upper wall of the second slot.

22. The work station as defined in claim 21, wherein the first support ledge, second support ledge and third support ledge are separate outwardly projecting flanges.

23. The work station as defined in claim 22, further including an inwardly projecting first bumper configured so as to abut the leading edge of the leg of the ladder and to position the support member against the outer surface of the leg of the ladder and totally within the imaginary planes formed by extending the leading and rear edges of the leg of the ladder and an inwardly projecting second bumper positioned so as to contact the leading edge of the leg of the ladder when an object being supported is substantially parallel to the ground.

24. The work station as defined in claim 23, wherein the first bumper is an inwardly projecting flange and the second bumper is a rear edge of the inwardly projecting flange forming the first bumper.

25. The work station as defined in claim 24, wherein the distance between the lower wall and the upper wall of the first slot is generally ¾ nominal inches and the distance between the lower wall and the upper wall of the second slot is generally 1½ nominal inches.

26. The work station as defined in claim 25, wherein the lower wall is greater than 2 inches.

27. The work station as defined in claim 18, wherein an object held within the opening is a substantially flat surface having a thickness approximately either 1½ nominal inches or ¾ nominal inches and a width at least the distance between the outer edges of the two legs of the ladder supporting the support members.

28. The work station as defined in claim 18, wherein each support member is made of metal.

29. A support member comprising:

a pivoting connection for rotatably connecting the member at a fixed height to a leg of a ladder and for permitting the support member to rotate relative to the leg, the leg of the ladder having a leading edge, a rear edge and opposed side edges;

means associated with the member for permitting the support member rotate relative to the leg between an in-use position wherein an object disposed within an opening at a distal end thereof can be held parallel to the ground directly in front of the leading edge of the ladder leg and a non-use, stow-away position; and, means integral with the member acting as a stop to contact the ladder and to position each support member within the imaginary planes formed by extending the leading and rear edges of the leg of the ladder.

30. The support member as defined in claim 29, wherein the pivoting connection comprising a pivot pin passing through aligned apertures in the support member and the side of the leg of the ladder.

31. The support member as defined in claim 30 wherein the support member has more than one aperture therein for attaching the member to a rear leg of the ladder.

32. The support member as defined in claim 29, further including an opening at a distal end thereof for holding an object disposed within the opening, wherein the opening in the support member is a slot having an upper wall and parallel lower wall, an object being held and disposed within the slot.

33. A support member adapted for use on a ladder having a leg, the support member comprising:

means for rotatable connecting the member at a fixed height to the leg, said means being a pivoting connection permitting the support member to rotate relative to the leg between an in-use position wherein an object disposed within the opening can be held parallel to the ground and a non-use, stow-away position, the pivoting connection comprising a pivot pin passing through aligned apertures in the support member and the side of the leg of the ladder; and, means associated with the member for supporting an object parallel to the ground, the object being held within the opening is a substantially flat surface having a thickness approximately either 1½ nominal inches or ¾ nominal inches and a width at least the distance between the outer edges of the two legs of the ladder supporting the support members.

34. A support member adapted for use on a ladder having a leg, the leg of the ladder having an outer surface and a leading edge and a rear edge, the support member comprising:

means for rotatably connecting the member at a fixed height to the leg; and, means associated with the member for supporting an object parallel to the ground an opening at a distal end thereof for holding an object disposed within the opening, wherein the opening in each support member is a slot having an upper wall and parallel lower wall, an object being held and disposed within the slot;

an inwardly projecting first bumper configured so as to abut the leading edge of the leg of the ladder and to position the support member against the outer surface of the leg of the ladder and totally within the imaginary planes formed by extending the leading and rear edges of the leg of the ladder; and, an inwardly projecting second bumper positioned so as to contact the leading edge of the leg of the ladder when an object being supported is substantially parallel to the ground.

35. The support member as defined in claim 34, wherein the second bumper is a rear edge of the first bumper.

36. The support member as defined in claim 35, wherein the distance between the lower wall and the upper wall of the opening is generally either 1½ nominal inches or ¾ nominal inches, and the lower wall is at least 2 inches.

37. A support member comprising:

means for rotatably connecting the support member at a fixed height to a leg of a ladder;

means associated with the member for supporting an object parallel to the ground; and, an opening at a distal end thereof for holding an object disposed within the opening, wherein the opening is at least two contiguous slots juxtaposed adjacent one another, both slots sharing a lower wall and each slot having an upper wall parallel the lower wall, the distance between the upper wall of the first slot and the lower wall being less than the distance between the upper wall of the second slot and the lower wall, an object being held between the lower wall and the upper wall of either the first slot or the second slot.

38. The support member as defined in claim 37, wherein each leg of the ladder has an outer surface and a leading edge and a rear edge and further including an inwardly projecting first bumper configured so as to abut the leading edge of the leg of the ladder and to position the support member against the outer surface of the leg of the ladder and totally within the imaginary planes formed by extending the leading and rear edges of the leg of the ladder and an inwardly projecting second bumper positioned so as to contact the leading edge of the leg of the ladder when an object being supported is substantially parallel to the ground.

39. The support member as defined in claim 38, wherein the first bumper is an inwardly projecting flange and the second bumper is a rear edge of the inwardly projecting flange forming the first bumper.

40. The support member as defined in claim 39, wherein the distance between the lower wall and the upper wall of the first slot is generally 13/16 inches and the distance between the lower wall and the upper wall of the second slot is generally 1 9/16 inches and the lower wall is at least 2 inches.

41. The support member as defined in claim 40, wherein an object being held within the opening is a substantially flat surface having a thickness approximately either ¾ nominal inches or 1½ nominal inches and a width at least the distance between the outer edges of the two legs of the ladder supporting the support members.

* * * * *

UNITED STATES PATENT AND TRADEMARK OFFICE

CERTIFICATE OF CORRECTION

PATENT NO. : 6,264,151 B1
DATED : July 24, 2001
INVENTOR(S) : Charles V. Schiller It is certified that error appears in the above-identified patent and that said Letters Patent is hereby corrected as shown below:

Title page,
Item [57],
Line 4, delete "rotatable" and insert therefor -- rotatably --.
Line 5, delete "bracket to the leg, (4)" and insert therefor -- bracket to the leg (4) --.

Column 9,
Line 1, delete "rotatable" and insert therefor -- rotatably --.

Signed and Sealed this

Fifteenth Day of October, 2002

*Attest:*

*Attesting Officer*

JAMES E. ROGAN
*Director of the United States Patent and Trademark Office*